US008651634B2

(12) United States Patent
Itogawa

(10) Patent No.: US 8,651,634 B2
(45) Date of Patent: Feb. 18, 2014

(54) LIQUID EJECTION DEVICE HAVING IMAGE DATA PROCESSING UNIT

(75) Inventor: Yoshihiro Itogawa, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 627 days.

(21) Appl. No.: 13/015,384

(22) Filed: Jan. 27, 2011

(65) Prior Publication Data

US 2011/0211205 A1 Sep. 1, 2011

(30) Foreign Application Priority Data

Feb. 26, 2010 (JP) ..... 2010-041429

(51) Int. Cl.
*B41J 2/12* (2006.01)

(52) U.S. Cl.
USPC ..... 347/78

(58) Field of Classification Search
USPC ..... 347/73, 78, 79, 188
See application file for complete search history.

(56) References Cited

U.S. PATENT DOCUMENTS

| | | | | |
|---|---|---|---|---|
| 6,094,280 A * | 7/2000 | Hayasaki et al. | ..... | 347/188 |
| 6,439,683 B1 | 8/2002 | Matsumoto et al. | | |
| 8,462,381 B2 * | 6/2013 | Yamazaki | ..... | 347/78 |
| 2002/0101472 A1 | 8/2002 | Tsuboi et al. | | |
| 2007/0139452 A1 | 6/2007 | Yamane | | |
| 2009/0196652 A1 | 8/2009 | Sakuma | | |

FOREIGN PATENT DOCUMENTS

| | | | | |
|---|---|---|---|---|
| JP | 6-135005 | * | 10/1992 | ..... B41J 2/205 |
| JP | H11-320864 | A | 11/1999 | |
| JP | 2002-144599 | A | 5/2002 | |
| JP | 2007-083576 | A | 4/2007 | |
| JP | 2007-136722 | A | 6/2007 | |
| JP | 2007-144681 | A | 6/2007 | |
| JP | 2007-185957 | A | 7/2007 | |
| JP | 2008-080740 | A | 4/2008 | |
| JP | 2009-181077 | A | 8/2009 | |

* cited by examiner

*Primary Examiner* — Kristal Feggins
(74) *Attorney, Agent, or Firm* — Baker Botts L.L.P.

(57) ABSTRACT

An image data processing device processes image data. The image data processing device includes an image data storing unit, a correction data producing unit, and an image density value addition unit. The image density value is either a first density value that is greater than or equal to a prescribed value or a second density value that is less than the prescribed value. The ink droplet is ejected on the first subject pixel whereas the ink droplet is unejected on the second subject pixel. The correction data producing unit produces correction data including a plurality of correction density values. The image density value addition unit adds the correction density value to the second density value of the corresponding pixel. The correction data producing unit produces a first correction density value and a second correction density value as the correction density value.

8 Claims, 8 Drawing Sheets

LIQUID EJECTION DEVICE HAVING IMAGE DATA PROCESSING UNIT

CROSS REFERENCE TO RELATED APPLICATION

This application claims priority from Japanese Patent Application No. 2010-041429 filed Feb. 26, 2010. The entire content of this priority application is incorporated herein by reference.

TECHNICAL FIELD

The present invention relates to an image data processing device for processing an image data representing an image to be formed on a recording medium by ejecting ink droplets from a plurality of nozzles. The invention relates further to a liquid ejection device including the image data processing device, and also to a non-transitory computer readable storage medium storing a set of programs that control the liquid ejection device.

BACKGROUND

In a liquid ejection device, ink viscosity is critical in maintaining the quality of image to be printed on a recording medium. In order to recover an ink droplet ejecting property which may be degraded by increased viscosity of the ink staying in the nozzle of an inkjet head, the ink droplets are auxiliarily ejected at prescribed intervals from unused nozzles onto a blank area of the recording medium in which the image is not formed.

SUMMARY

Even if the image formation is not made on the blank area of the recording medium, auxiliary ink ejection of the ink droplets onto the blank area may adversely affect the print quality of the image formed on a print area of the recording medium in which the image is formed.

In view of the foregoing, it is an object of the invention to recover the ink droplet ejecting property and prevent an image quality from degrading.

In order to attain the above and other objects, the invention provides an image data processing device. The image data processing device processes image data supplied to a liquid ejection device having an inkjet head formed with a plurality of nozzles from which ink droplets are ejectable onto a recording medium. The recording medium has an image formable area defined by a plurality of pixels. A predetermined number of pixels is arranged in one-to-one correspondence with the plurality of nozzles. An image is formed on the image formable area of the recording medium while moving at least one of the inkjet head and the recording medium relative to each other. The image data processing device includes an image data storing unit, a correction data producing unit, and an image density value addition unit. The image data storing unit stores image data representing an image density value for each of the plurality of pixels. The image density value is either a first density value that is greater than or equal to a described value or a second density value that is less than the prescribed value. The correction data producing unit produces correction data including a plurality of correction density values. The image density value addition unit adds the correction density value to the second density value of the corresponding pixel. The correction data producing unit produces a first correction density value and a second correction density value as the correction density value. The first correction density value is added to the second density value by the image density value addition unit. A resultant density value of a first subject pixel is equal to or greater than the first density value. The ink droplet has been unejected from one of the plurality of nozzles corresponding to the first subject pixel for a first predetermined period of time. The second correction density value is added to the second density value by the image density value addition unit. A resultant density value of a second subject pixel is less than the first density value. The ink droplet has been unejected from one of the plurality of nozzles corresponding to the second subject pixel for a period of time shorter than the first predetermined period of time. The ink droplet is ejected on the first subject pixel whereas the ink droplet is unejected on the second subject pixel.

According to another aspect, the present invention provides a liquid ejection device. The liquid ejection device includes a liquid droplet ejecting head and an image processing device. The liquid droplet ejecting head ejects liquid droplets from a plurality of nozzles. The image data processing device processes image data supplied to the liquid droplet ejecting head. The liquid droplets is ejectable onto a substrate. The substrate has a liquid depositing area defined by a plurality of pixels. A predetermined number of pixels is arranged in one-to-one correspondence with the plurality of nozzles. An image is formed on the liquid depositing area of the substrate while moving at least one of the liquid droplet ejecting head and the substrate relative to each other. The image data processing device includes an image data storing unit, a correction data producing unit and an image density value addition unit. The image data storing unit stores image data representing an image density value for each of the plurality of pixels. The image density value is either a first density value that is greater than or equal to a prescribed value or a second density value that is less than the prescribed value. The correction data producing unit produces correction data including a plurality of correction density values. The image density value addition unit adds the correction density value to the second density value of the corresponding pixel. The correction data producing unit produces a first correction density value and a second correction density value as the correction density value. The first correction density value is added to the second density value by the image density value addition unit. A resultant density value of a first subject pixel is equal to or greater than the first density value. The liquid droplet has been unejected from one of the plurality of nozzles corresponding to the first subject pixel for a first predetermined period of time. The second correction density value is added to the second density value by the image density value addition unit. A resultant density value of a second subject pixel is less than the first density value. The liquid droplet has been unejected from one of the plurality of nozzles corresponding to the second subject pixel for a period of time shorter than the first predetermined period of time. The liquid droplet is ejected on the first subject pixel whereas the liquid droplet is unejected on the second subject pixel.

According to still another aspect, the present invention provides a computer readable storage medium storing a computer-executable program for controlling the computer that controls an ink droplet ejection device having an inkjet head formed with a plurality of nozzles from which ink droplets are ejectable onto a recording medium, the recording medium having an image formable area defined by a plurality of pixels wherein a predetermined number of pixels is arranged in one-to-one correspondence with the plurality of nozzles, an image being formed on the image formable area of the recording medium while moving at least one of the inkjet head and the recording medium relative to each other, program including storing image data representing an image density value for each of the plurality of pixels, the image density value being either a first density value that is greater than or equal to a prescribed value or a second density value that is less than the prescribed value, producing correction data including a plurality of correction density values, and adding the correction density value to the second density value of the corresponding pixel, wherein a first correction density value and a second correction density value is produced as the correction density value in the producing step, the first correction density value being added to the second density value by the adding step, a resultant density value of a first subject pixel being equal to or greater than the first density value, the ink droplet having been unejected from one of the plurality of nozzles corresponding to the first subject pixel for a first predetermined period of time, the second correction density value being added to the second density value by the adding step, a resultant density value of a second subject pixel being less than the first density value, the ink droplet having been unejected from one of the plurality of nozzles corresponding to the second subject pixel for a period of time shorter than the first predetermined period of time, wherein the ink droplet is ejected on the first subject pixel whereas the ink droplet is unejected on the second subject pixel.

BRIEF DESCRIPTION OF THE DRAWINGS

The particular features and advantages of the invention as well as other objects will become apparent from the following description taken in connection with the accompanying drawings, in which:

FIG. 6(*b*) is an explanatory diagram explaining a quantization process in a region surrounded by dotted-line in FIG. 6(*a*);

DETAILED DESCRIPTION

Figure 1:
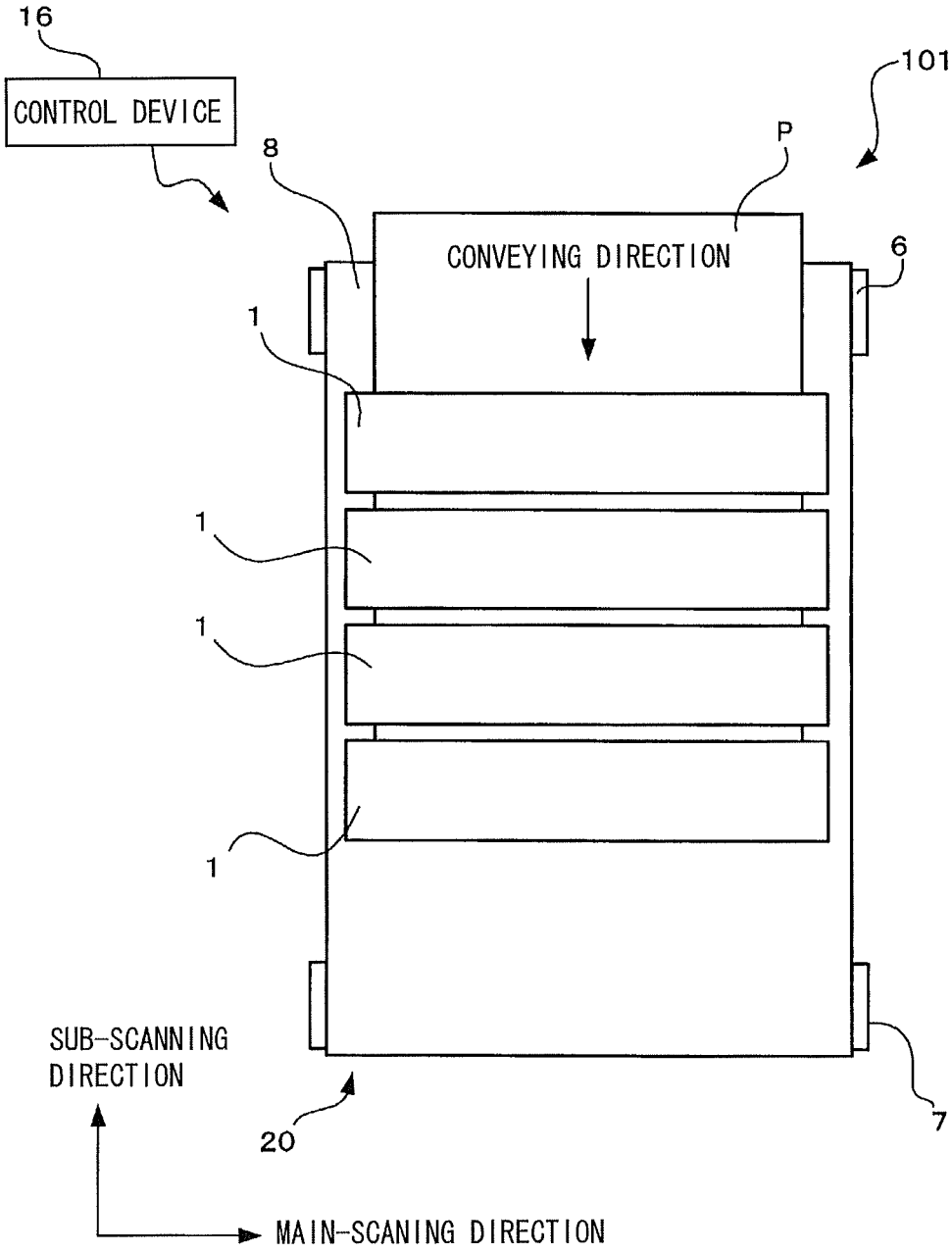
FIG. 1 is a schematic plane view showing an inkjet printer according to an embodiment of the present invention.

An inkjet printer 101 according to an embodiment of the invention will be described while referring to the accompanying drawings wherein like parts and components are designated by the same reference numerals to avoid duplicating description.

An inkjet printer 101 includes a conveying unit 20 for conveying a sheet of paper P downward as seen in FIG. 1, four inkjet heads 1 each ejecting one of four colors of ink, i.e., black, magenta, cyan, and yellow, onto the sheet P having conveyed beneath the corresponding inkjet head, and a control device 16 for performing an overall control of the inkjet printer 101. It is noted that a sub-scanning direction is defined to a direction parallel to a sheet conveying direction in which the conveying unit 20 conveys the sheet P and a main-scanning direction is defined to a direction orthogonal to the sub-scanning direction and parallel to a horizontal plane. The term "auxiliary ejection" as used herein is intended to mean ejection of droplet in a printing region of the sheet P where image formation is not performed.

The conveying unit 20 includes a pair of belt rollers 6 and 7 disposed in spaced-apart relation and an endless conveying belt 8 looped around and taut between the belt rollers 6 and 7. The belt roller 7 is a drive roller rotated by driving force transferred from a conveying motor (not shown). The belt roller 6 is a follower roller rotated by running the conveying belt 8 by the rotation of the belt roller 6. The sheet P rested on an outer surface of the conveying belt 8 is conveyed from top to bottom of FIG. 1.

Four inkjet heads 1 are arranged in the sub-scanning direction parallel with one another and each extends in the main-scanning direction. That is, the inkjet printer 101 is a line-type inkjet printer in which a plurality of nozzles 108 for ejecting ink droplets is arranged in the main-scanning direction or widthwise direction of the sheet P (see FIG. 3). Each inkjet head 1 has a bottom surface serving as an ejection surface where the plurality of nozzles 108 is arranged.

The conveying belt 8 has an upper running section of which an outer surface is in confrontation with and parallel to the ejection surface. When the sheet P conveyed by the conveying belt 8 passes through an immediately below the inkjet head 1, each inkjet head 1 ejects each color of ink onto the upper surface of the sheet P, thereby forming a desired color image on the sheet P.

Figure 2:
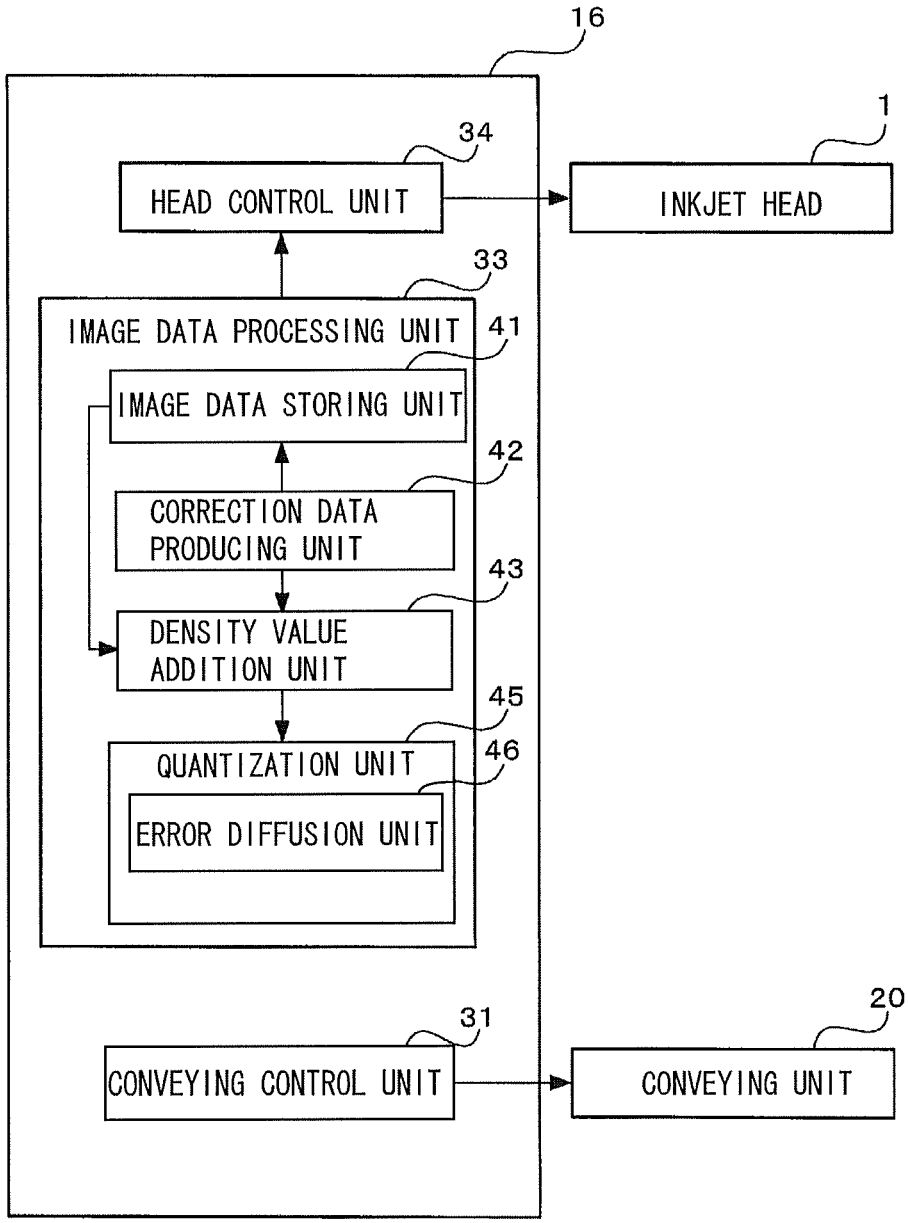
FIG. 2 is a functional block diagram showing a control device of the inkjet printer.

Next, the control device 16 will be described with reference to FIG. 2. The control device 16 includes a CPU (Central Processing Unit), an EEPROM (Electrically Erasable and Programmable Read-Only Memory) that is a rewritable memory which stores programs executed by the CPU and data used by the programs, and a RAM (Random Access Memory) for temporarily storing the data while running the program. Each component of the control device 16 is configured of the above-mentioned hardware in cooperation with the software stored in the EEPROM. As shown in FIG. 2, the control device 16 includes a conveying control unit 31, an image data processing unit 33, and a head control unit 34.

The conveying control unit 31 controls the conveying motor provided in the conveying unit 20 such that the sheet P is conveyed at a desired speed in the sheet conveying direction.

The image data processing unit 33 executes preprocessing of the image data 70 representing an image to be printed on the sheet P. The image data processing unit 33 includes an image data storing unit 41, a correction data producing unit 42, a density value addition unit 43, and a quantization unit 45. The image data storing unit 41 stores four sets of image data 70 corresponding to four colors, magenta, cyan, yellow, and black that are printed in a superimposed manner to reproduce a full color image. Each set of image data 70 includes a plurality of pixels arranged in a matrix form in the printing region and indicates a density value of each pixel in one of four colors. The density value of each pixel can be evaluated by a minimum ejecting density value (which is a prescribed value and will be referred to as "MED value" hereinafter) in which a minimum amount of ink is ejected to form a small-size ink droplet. The pixel density value may be more than or equal to the MED value or less than the MED value. In the former case, one of large-size, middle-size, and small-size ink droplet is formed depending upon the pixel density value. On the other hand, the ink is not ejected when the pixel density value is less than the MED value.

Figure 3:
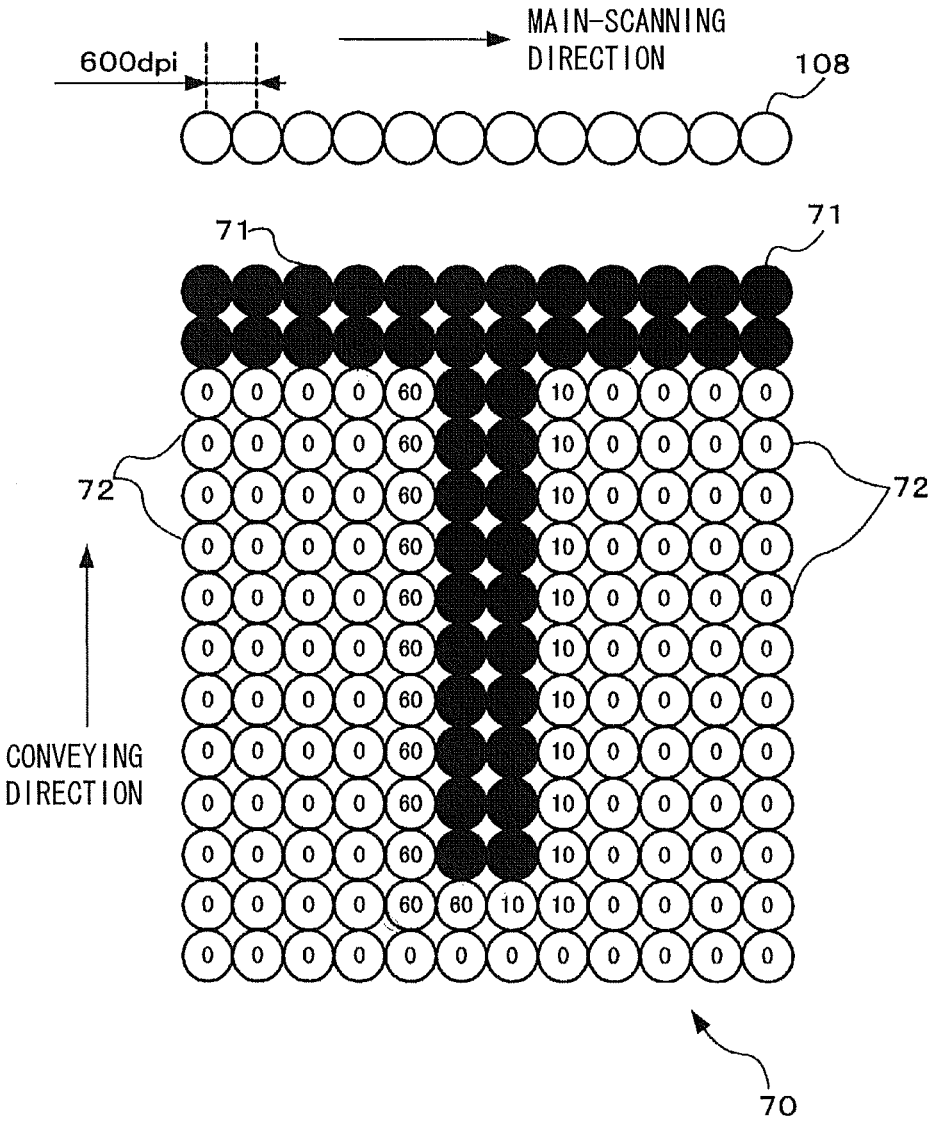
FIG. 3 is an explanatory diagram conceptually illustrating image data stored in an image data storage unit.

In FIG. 3, a pixel 71 having more than or equal to the MED value (corresponding to the large-size, middle-size, or small-size ink droplet) is depicted with a black dot and a pixel 72 having less than the MED value is depicted with a density value ratio (%) with respect to the MED value set to 100%. The image data 70 is assumed to have a resolution of 600 dpi×600 dpi. The image with 600 dpi×600 dpi resolution may be produced by lowering a higher resolution image data, for example 1200 dpi×1200 dpi. Alternatively, the image with 600 dpi×600 dpi resolution may be produced by expanding a resolution of a smaller resolution image data, for example 300 dpi×300 dpi. The resolution of the image data 70 is not limited to 600 dpi×600 dpi but may take a desired value.

Figure 4:
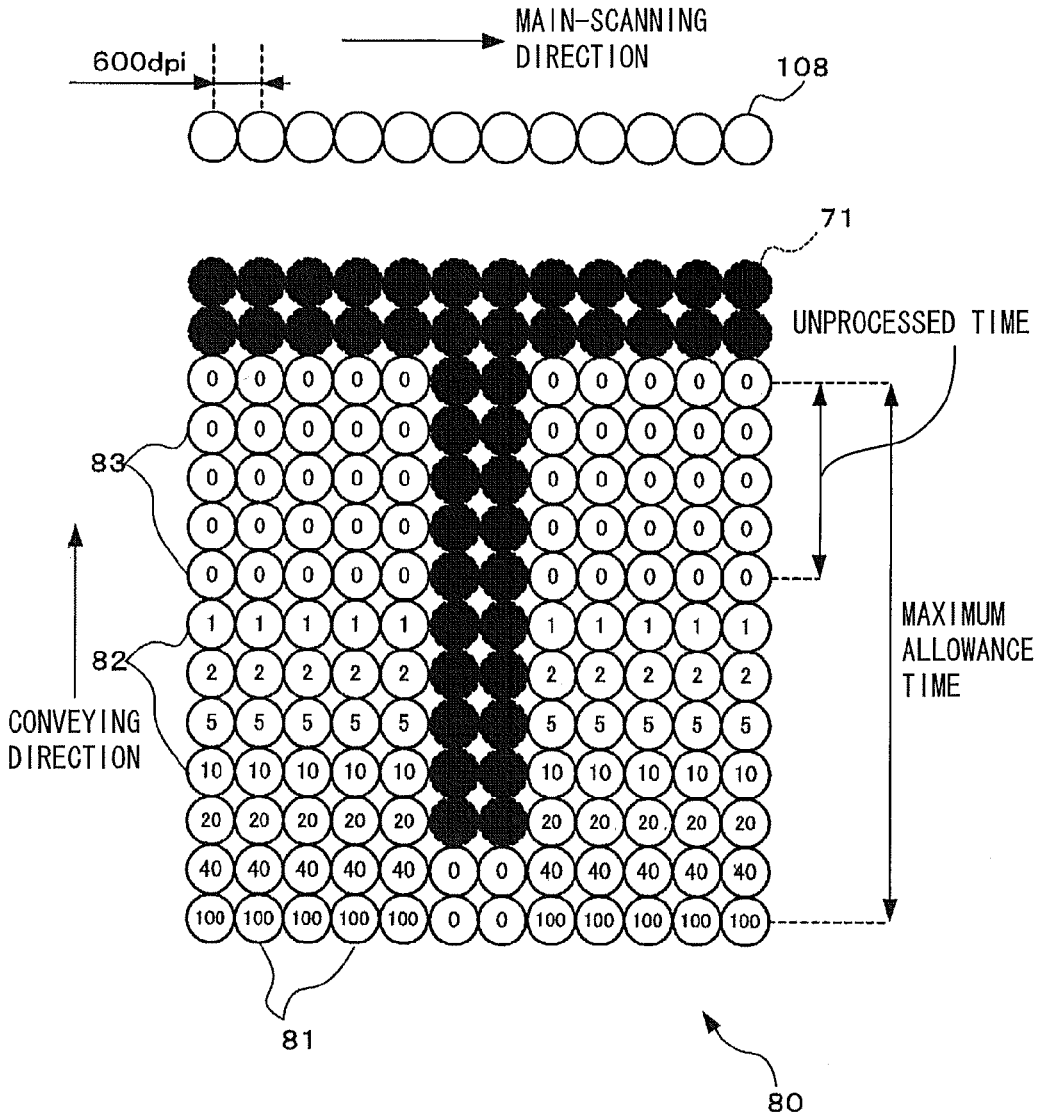
FIG. 4 is an explanatory diagram conceptually illustrating correction data produced by a correction data producing unit.

The correction data producing unit 42 produces, as shown in FIG. 4, correction data 80 representing a correction density value to be added to the original density value of each pixel 72 of the image data 70. The addition of the correction density value to the original density value is implemented by the density value addition unit 43. The correction data 80 is produced so that an unejected period of time for which the ink droplet has been unejected is within a maximum allowance time t1. FIG. 4 shows the correction data 80 together with the pixels 71 of the image data 70.

The correction data producing unit 42 produces and applies a first correction density value to the pixel 72 of the image data 70 corresponding to the pixel 81 of the correction data 80. The first correction density value is set to the MED value (100%) and is produced when the unejected period of time reaches the maximum allowance time t1. Thus, the density value of the pixel 72 to which the first correction density value is applied results in a correction density value more than or equal to the MED value. The nozzle 108 corresponding to the pixel 81 subject to the data correction with the first correction density value performs the auxiliary ink ejection.

Figure 5:
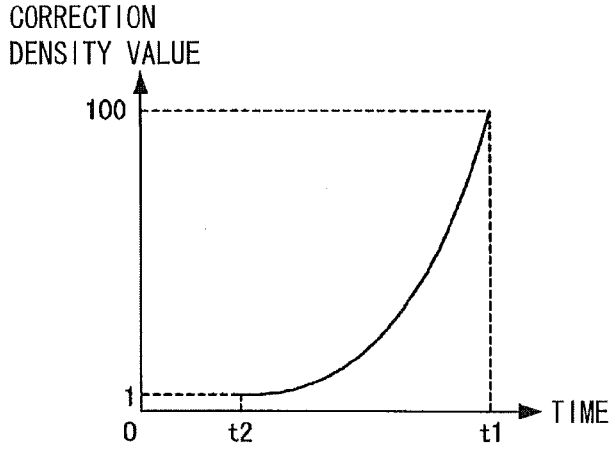
FIG. 5 is a graphical representation showing a relationship between a correction density value and an elapsed time from when ink droplet is ejected.

The correction data producing unit 42 further produces, as shown in FIGS. 4 and 5, a second correction density value when the unejected period of time is longer than an unprocessing time t2 but shorter than the maximum allowance time t1. The unprocessing time t2 is set shorter than the maximum allowance time t1. For example, the unprocessing time t2 is set to a half of the maximum allowance time t1. The second correction value is not a fixed value but increasingly varies as the unejected period of time becomes longer and approaches to the maximum allowance time t1. The second correction value is applied to the pixels having density values less than the MED value.

Specifically, the second correction values produced from the correction data producing unit 42 are 1%, 2%, 5%, 10%, 20%, and 40% which correction values are sequentially produced in the stated order as the unejected period of time becomes longer. Thus, the density value of the pixel 82 corresponding to the pixel 72 becomes larger as the unejected period of time continues and approaches the maximum allowance time t1. As a result, likelihood of the auxiliary ink ejection would increase in the nozzle 108 corresponding to the pixel 72.

The correction data producing unit 42 further produces a third correction density value. The third correction density value is set to zero (0) and applied to the pixels 83 coming beneath the corresponding nozzles 108 within a period of time shorter than the unprocessing time t2. Thus, no correction is made to the density values of such pixels 72. As a result, the nozzle 108 corresponding to the pixel 72 does not perform the auxiliary ink ejection.

Figure 6A:
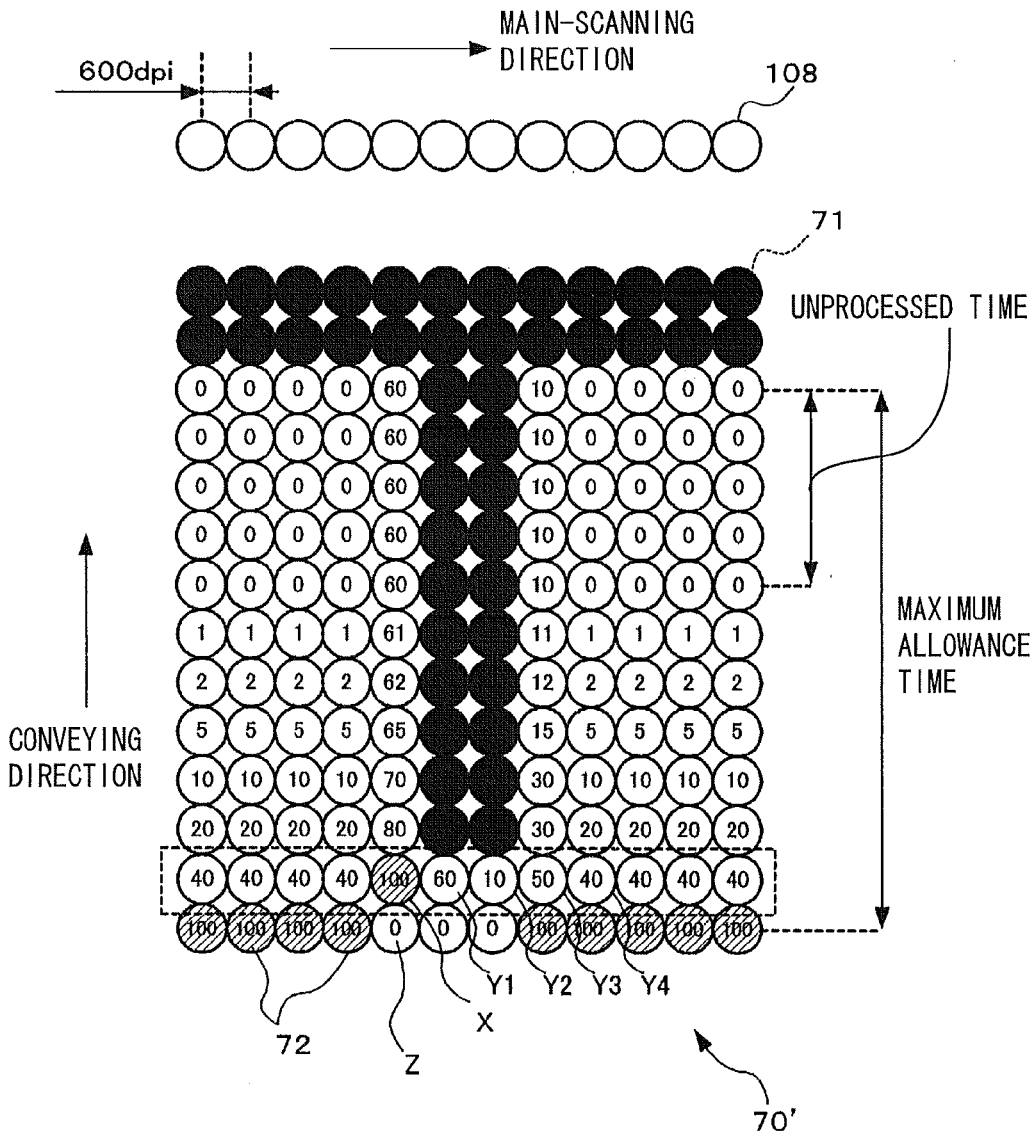
FIG. 6(*a*) is an explanatory diagram conceptually illustrating corrected image data produced by a density value addition unit.
Figure 6B:
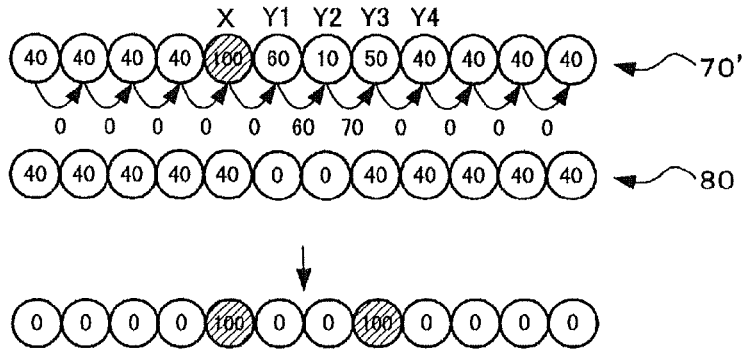

As shown in FIG. 6(*a*), the density value addition unit 43 adds the correction density value of each of the pixels 81, 82, and 83 to the density value of the corresponding pixel 72, thereby producing correction image data 70' in which the density vale of the pixel 72 is corrected.

If the density value addition unit 43 finds a pixel X of which density vale changes from less than the MED value to more than or equal to the MED value as a result of the above-mentioned addition process, timing of the maximum allowance time t1 is re-started from a pixel Z immediately below the pixel X in FIG. 6, i.e., an upstream side of the pixel X in the sheet conveying direction. The density value addition unit 43 executes the above-mentioned addition process with respect to all of the pixels 72 of the image data 70.

The quantization unit 45 produces quantization data 70" which selectively takes one of four different quantized density values corresponding to the large-size, middle-size, small-size ink drops, and non-ejection of ink. Specifically, the quantization unit 45 quantizes the pixel whose density value is between more than or equal to 100(%) and less than 200(%) to the small-size ink drop. The quantization unit 45 has an error diffusion unit 46 as shown in FIG. 2.

As shown in FIGS. 6(*a*) and 6(*b*), the quantization unit 45 quantizes the corrected density value of each pixel to one of four values based on a prescribed threshold value. The prescribed threshold value is set to 100%, when the correction density value is more than or equal to 100%, and the prescribed threshold value is set to 0%, when the correction density value is less than 100%. The quantization is executed with respect to the pixels from the downstream side toward the upstream side in the sheet conveying direction and from one end toward the other end in the main scanning direction (from left to right in FIG. 6(*a*)).

The error diffusion unit 46 executes an error diffusion by adding a diffusion value to the density value of the pixel next to the subject pixel located in the main scanning direction on the same pixel line. The diffusion value is obtained by subtracting the correction density value from a difference obtained by subtracting the prescribed threshold value from the density value of the pixel of the correction image data 70'. If the diffusion value thus obtained is a negative value, the error diffusion unit 46 does not add the diffusion value to the density value of the pixel next to the subject pixel used for calculating the diffusion value.

For example, in FIG. 6(*b*), the density values of all the pixels positioned at the left side of the pixel X are at 40% in the correction image data 70'. That is, the density values of these pixels are less than the MED value, and thus quantized to 0 (zero). Then, the diffusion value, which is calculated by subtracting the correction density value (40%) of the pixel of the correction data 80 from the difference (40%) between the density value (40%) of the pixel of the correction image data 70' and the prescribed threshold value (0%), is at 0 (zero), and thus the diffusion value is not added to the density value of the pixel X.

Next, the density value of the pixel X is at 100% equal to the MED value, and the quantized density value of pixel X is quantized to generate a small-size ink droplet. Then, the diffusion value, which is calculated by subtracting the correction density value (40%) from the difference (0%) between the density value of the pixel X (100%) and the prescribed threshold value (100%), is the negative value, and thus the diffusion value is not added to a pixel Y1 next to the pixel X in the main scanning direction.

Since the density value of the pixel Y1 is at 60%, the quantized density value of pixel Y1 is quantized to 0 (zero). Then, the diffusion value, which is calculated by subtracting the correction density value (0%) from the difference (60%) between the density value of the pixel Y1 (60%) and the prescribed threshold value (0%), is at 60%, and thus the diffusion value is added to a pixel Y2 next to the pixel Y1. As a result, the density value of Y2 is at 70%.

By repeatedly executing this error diffusion, the density vale of a pixel Y3 next to the pixel Y2 is at 120% (60%+10%+50%) and exceeds the MED value. The density value exceeding the MED value is quantized to one of the quantized density values corresponding to the small-size, middle-size, large-size ink droplets. The quantized value of pixel Y3 is quantized to the small-size ink drop in FIG. 6(*b*). Then, the diffusion value, which is calculated by subtracting the correction density value (40%) of the pixel of the correction data 80 corresponding to the pixel Y1 from the difference (20%) between the density value of the pixel Y3 (120%) and the prescribed threshold value (100%), is a negative value, and thus the diffusion value is not added to a pixel Y4 next to the pixel Y3.

Figure 7:
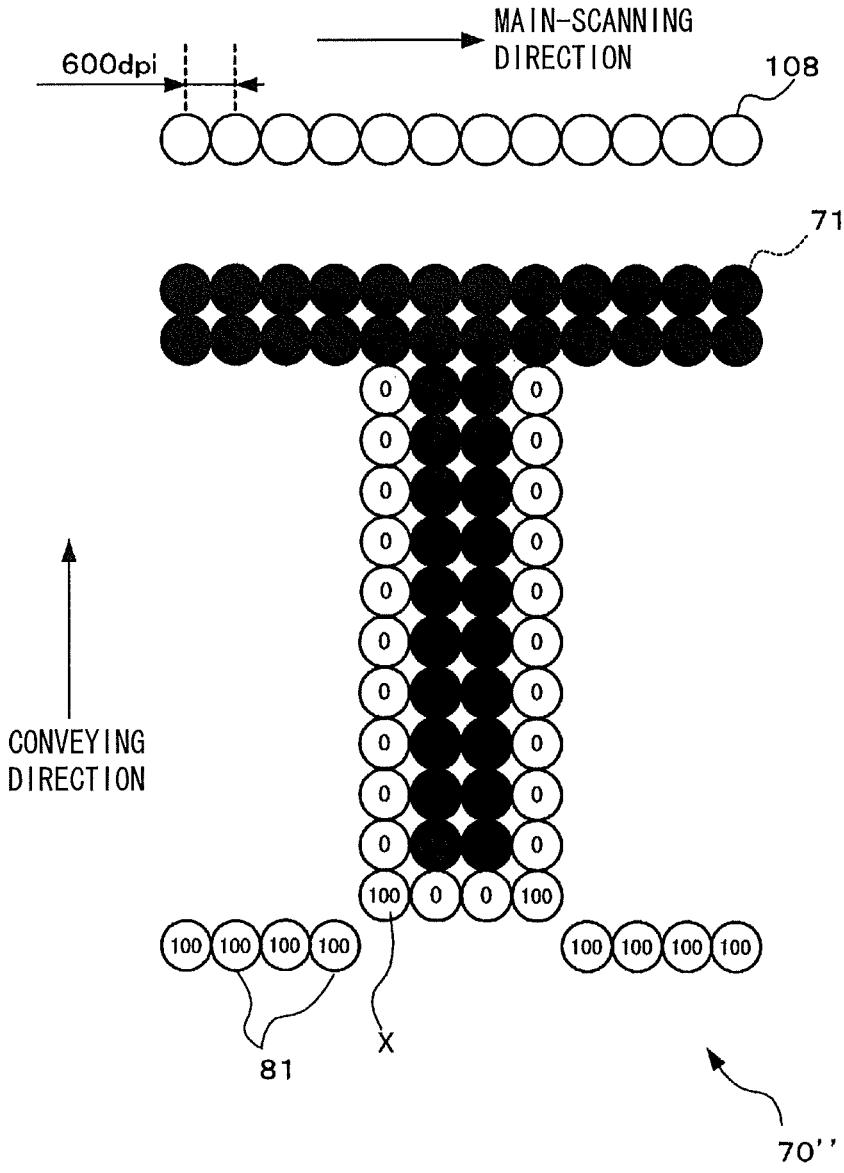
FIG. 7 is an explanatory diagram illustrating quantization data produced by a quantization unit.

The correction density value added by the density value addition unit 43 is subtracted from the density value of the pixel of the correction image data 70' other than the quantized value of pixels quantized to the small-size ink droplet during the error diffusion executed by the error diffusion unit 46. As shown in FIG. 7, production of the quantization data 70" is completed upon quantizing the density value of all of the pixels by the quantization unit 45.

The head control unit 34 ejects the ink droplet having a prescribed volume at a desired timing from each nozzle 108 based on the quantization data 70" produced by the quantization unit 45.

Figure 8:
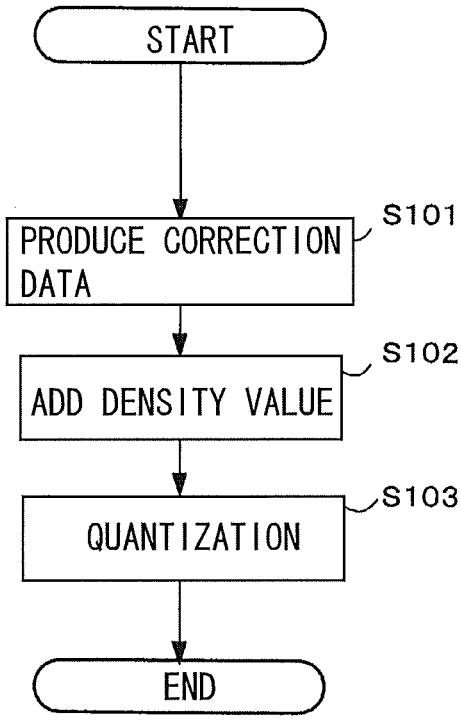
FIG. 8 is a flowchart explaining the operation of an image data processing unit.

Next, a preprocessing of the image data 70 will be described with reference to FIG. 8. The preprocessing of the image data 70 is started upon receipt of a print command from an associated computer. When the preprocessing of the image data 70 is started, the correction data producing unit 42 produces the correction data 80 including the correction density value representing each pixel corresponding to the pixel 72, whose density value is less than the MED value, of the image data 70 stored in the image data storing unit 41 (S101).

Then, the correction data producing unit 42 produces the correction data 80 such that the third correction value, which is the correction density value of the pixel 83 corresponding to the nozzle 108 in which the unejected period of time is shorter than the unprocessing time t2, is at 0 (zero), the second correction value, which is the correction density value of the pixel 82 corresponding to the nozzle 108 in which the unejected period of time is longer than the unprocessing time t2 but shorter than the maximum allowance time t1, varies such that the increasing rate of the second correction value becomes larger as the unejected period of time becomes longer and approaches to the maximum allowance time t1 in the region less than the MED value, and the first correction value, which is the correction density value of the pixel 81 corresponding to the nozzle 108 in which the unejected period of time reaches the maximum allowance time t1, is the MED value.

The density value addition unit 43 produces the correction image data 70' by adding the correction density value of the pixels 81, 82, and 83 to the density value of the pixel 72 (S102). The quantization unit 45 produces the quantization data 70" by diffusing the density value of each pixel of the correction image data 70' and quantizing at the corresponding quantized density value the large-size, middle-size, small-size ink droplets and non-ejection of ink (S103). The preprocessing of image data 70 is hereby ended.

With this configuration, since the unejected period of time from each nozzle 108 is within the maximum allowance time t1, an ink ejecting property of the nozzle 108 can be recovered. By adding the correction density value of the pixel 82 to the density value of the pixel 72, the auxiliary ink ejection tends to be executed as the density value increases in the region less than the MED value. The auxiliary ink ejection may be executed in the nozzle 108 of the pixel 72, for example the pixel X of FIGS. 6(*a*) and 6(*b*), whose density value does not reach the MED value, thereby preventing an image quality from degrading in comparison with a case where the auxiliary ink ejection is executed at a preset pattern.

Since the correction density value of the pixel 82 corresponding to the nozzle 108 in which the unejected period of time is longer than the unprocessing time t2 but shorter than the maximum allowance time t1 varies such that the increasing rate of the correction density value becomes larger as the unejected period of time becomes longer and approaches to the maximum allowance time t1, likelihood that the auxiliary ink ejection is executed increases as the unejected period of time prolongs, thereby preventing the number of the auxiliary ink ejection from increasing and preventing the image quality from degrading.

The correction density value of the pixel 83 corresponding to the nozzle 108 in which the unejected period of time is shorter than the unprocessing time t2 is at 0 (zero), thereby preventing the number of the auxiliary ink ejection from increasing and saving the ink consumption.

Additionally, the error diffusion unit 46 of the quantization unit 45 diffuses the error generated by the quantization to the right side of the neighboring pixel. If the auxiliary ink ejection is executed in the pixel in which the second correction density value is added, the diffusion value added to the right-side neighboring pixel decrease and the auxiliary ink ejection may not be executed in the neighboring pixel. For example, in FIGS. 6(*a*) and 6(*b*), by executing the auxiliary ink ejection in the pixel X added to the correction density value, the auxiliary ink ejection is not executed in the pixel Y1 in which the auxiliary ink ejection is executed if the correction density value is not added (60%+60%=120%). The ink ejection of the pixel Y1 for contributing the image forming generated by the error diffusion is replaced with the auxiliary ink ejection of the pixel X replaced with the auxiliary ink ejection of a pixel Z, thereby saving the ink consumption.

In the above-described embodiment, the correction data producing unit 42 sets the correction density value of the pixel 81 corresponding to the nozzle 108 in which the unejected period of time reaches the maximum allowance time t1 to the MED value, whereby the auxiliary ink ejection is executed in the pixel 81 at any time.

Figure 9:
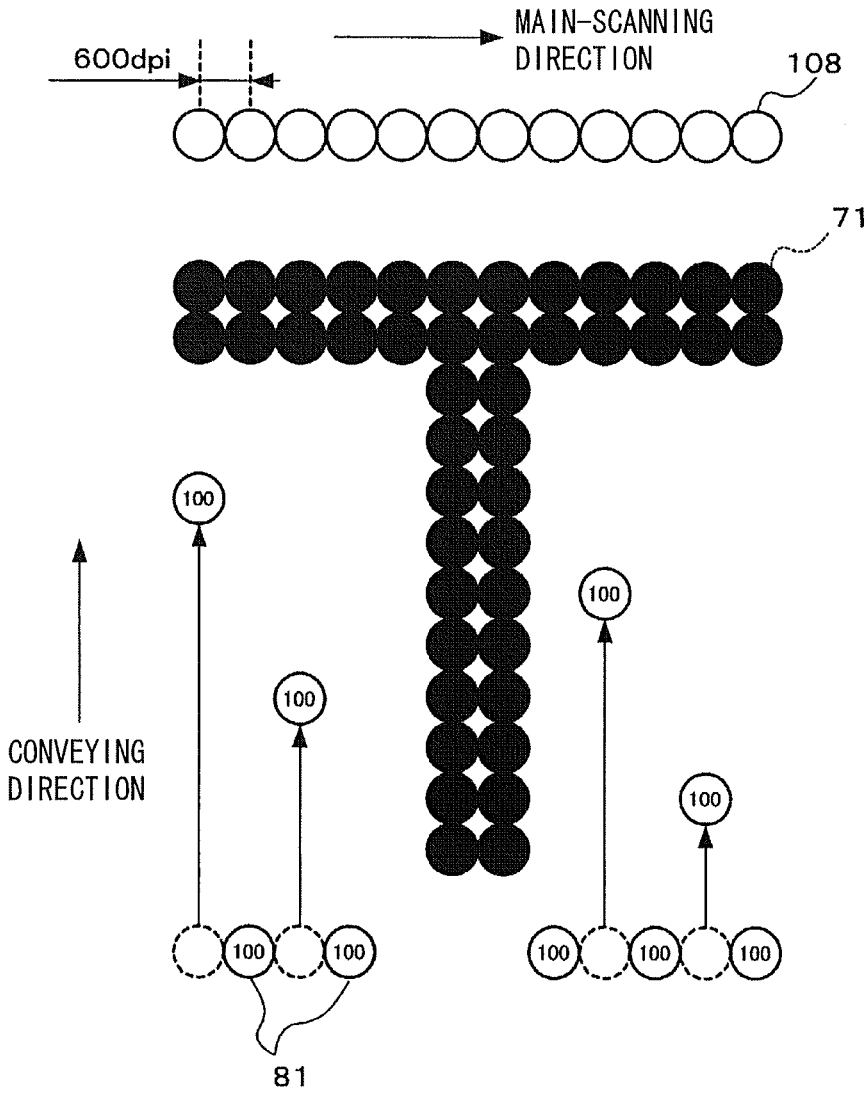
FIG. 9 is an explanatory diagram illustrating a modification of the embodiment.

However, in order to improve the image quality, the correction data producing unit 42 produces the correction data 80 such that the pixel having the correction density value equal to the MED value is randomly decided so as not to neighbor with each other as shown in FIG. 9. As a result, visibility of the dot formed by the auxiliary ink ejection can be lowered. In this case, an arrangement of the pixel having the correction density value equal to the MED value is decided such that the unejected period of time is within the maximum allowance time t1.

While the invention has been described in detail with reference to the embodiment thereof, it would be apparent to those skilled in the art that various changes and modifications may be made therein without departing from the spirit of the invention.

In the above-described embodiment, the second correction value, which is the correction density value of the pixel 82 corresponding to the nozzle 108 in which the unejected period of time is longer than the unprocessing time t2 but shorter than the maximum allowance time t1, varies such that the increasing rate of the second correction value becomes larger as the unejected period of time become longer and approaches to the maximum allowance time t1. However, the present invention is not limited to this configuration. The second correction value may proportionally vary as the unejected period of time become longer and approaches to the maximum allowance time t1. Alternatively, the second correction value may not vary. The unprocessing time t2 may be at 0 (zero).

In the above-described embodiment, the third correction value, which is the correction density value of the pixel 83 corresponding to the nozzle 108 in which the unejected period of time is shorter than the unprocessing time t2, is at 0 (zero). However, the third correction value may be arbitrarily set if the third correction value is less than or equal to a half of the MED value.

In the above-described embodiment, although the quantization unit 45 diffuses the error generated by the quantization to the right side neighboring pixel, an error diffusing direction or error diffusing range is arbitrarily selectable. The error diffusion is not essential and may not be executed.

In the above-described embodiment, although four inkjet heads 1 eject different colors of ink, two, three, or five inkjet heads 1 may be employed to eject different colors of the ink. One inkjet head 1 may eject a plurality of colors of ink.

In the above-described embodiment, although a line-type inkjet printer is employed, a serial-type inkjet printer may be employed instead.

The present invention is applicable to a device ejecting liquid droplets, not ink droplet. The present invention is not limited to the printer and is applicable to a facsimile or a copier device.

In the above-described embodiment, although the inkjet printer 101 is employed, an image data processing unit for processing the image data may be employed.

In the above-described embodiment, although the image data processing unit 33 is assembled in the inkjet printer 101, software installed in a PC (Personal Computer) or stored in a non-transitory computer readable storage medium, for example an application software performing an image process or a driver software controlling the inkjet printer, may function the PC as the image data processing unit.

What is claimed is:

1. An image data processing device for processing image data supplied to a liquid ejection device having an inkjet head formed with a plurality of nozzles from which ink droplets are ejectable onto a recording medium, the recording medium having an image formable area defined by a plurality of pixels wherein a predetermined number of pixels is arranged in one-to-one correspondence with the plurality of nozzles, an image being formed on the image formable area of the recording medium while moving at least one of the inkjet head and the recording medium relative to each other, the image data processing device comprising:

an image data storing unit that is configured to store image data representing an image density value for each of the plurality of pixels, the image density value being either a first density value that is greater than or equal to a prescribed value or a second density value that is less than the prescribed value;

a correction data producing unit that is configured to produce correction data including a plurality of correction density values; and an image density value addition unit that is configured to add the correction density value to the second density value of the corresponding pixel, wherein the correction data producing unit produces a first correction density value and a second correction density value as the correction density value, the first correction density value being added to the second density value by the image density value addition unit, a resultant density value of a first subject pixel being equal to or greater than the first density value, the ink droplet having been unejected from one of the plurality of nozzles corresponding to the first subject pixel for a first predetermined period of time, the second correction density value being added to the second density value by the image density value addition unit, a resultant density value of a second subject pixel being less than the first density value, the ink droplet having been unejected from one of the plurality of nozzles corresponding to the second subject pixel for a period of time shorter than the first predetermined period of time, wherein the ink droplet is ejected on the first subject pixel whereas the ink droplet is unejected on the second subject pixel.

2. The image data processing device according to claim 1, wherein the correction data producing unit produces the correction data such that the second correction value becomes larger as an unejected period of time for which the ink droplet has been unejected becomes longer and approaches to the first predetermined period of time.

3. The image data processing device according to claim 2, wherein the correction data producing unit produces the correction data such that an increasing rate of the second correction density value becomes larger as the unejected period of time becomes longer and approaches to the first predetermined period of time.

4. The image data processing device according to claim 1, wherein the correction data producing unit produces the correction data such that the second correction density value is less than a half of the prescribed value until an unejected period of time for which the ink droplet has been unejected reaches a second predetermined period of time shorter than the first predetermined period of time.

5. The image data processing device according to claim 1, further comprising a quantization unit that produces a quantized density value based on the resultant density value of the second subject pixel, the quantized density value representing a volume of the ink droplet, wherein the quantization unit includes an error diffusion unit that is configured to diffuse an error diffusion value generated upon production of the quantized density value to at least one of the neighboring pixels, and the quantization unit produces the quantized density value by adding the error diffusion value to the resultant density value of the second subject pixel.

6. The image data processing device according to claim 1, wherein the correction data producing unit produces the correction data such that the first subject pixel and a pixel having the first density value are not in neighboring relation to each other.

7. A liquid ejection device comprising:

a liquid droplet ejecting head that is configured to eject liquid droplets from a plurality of nozzles; and an image data processing device that is configured to process image data supplied to the liquid droplet ejecting head, the liquid droplets being ejectable onto a substrate, the substrate having a liquid depositing area defined by a plurality of pixels wherein a predetermined number of pixels is arranged in one-to-one correspondence with the plurality of nozzles, an image being formed on the liquid depositing area of the substrate while moving at least one of the liquid droplet ejecting head and the substrate relative to each other, the image data processing device including:

an image data storing unit that is configured to store image data representing an image density value for each of the plurality of pixels, the image density value being either a first density value that is greater than or equal to a prescribed value or a second density value that is less than the prescribed value;

a correction data producing unit that is configured to produce correction data including a plurality of correction density values; and an image density value addition unit that is configured to add the correction density value to the second density value of the corresponding pixel, wherein the correction data producing unit produces a first correction density value and a second correction density value as the correction density value, the first correction density value being added to the second density value by the image density value addition unit, a resultant density value of a first subject pixel being equal to or greater than the first density value, the liquid droplet having been unejected from one of the plurality of nozzles corresponding to the first subject pixel for a first predetermined period of time, the second correction density value being added to the second density value by the image density value addition unit, a resultant density value of a second subject pixel being less than the first density value, the liquid droplet having been unejected from one of the plurality of nozzles corresponding to the second subject pixel for a period of time shorter than the first predetermined period of time, wherein the liquid droplet is ejected on the first subject pixel whereas the liquid droplet is unejected on the second subject pixel.

8. A computer readable storage medium storing a computer-executable program for controlling the computer that controls an ink droplet ejection device having an inkjet head formed with a plurality of nozzles from which ink droplets are ejectable onto a recording medium, the recording medium having an image formable area defined by a plurality of pixels wherein a predetermined number of pixels is arranged in one-to-one correspondence with the plurality of nozzles, an image being formed on the image formable area of the recording medium while moving at least one of the inkjet head and the recording medium relative to each other, program comprising:

storing image data representing an image density value for each of the plurality of pixels, the image density value being either a first density value that is greater than or equal to a prescribed value or a second density value that is less than the prescribed value;

producing correction data including a plurality of correction density values; and adding the correction density value to the second density value of the corresponding pixel, wherein a first correction density value and a second correction density value is produced as the correction density value in the producing step, the first correction density value being added to the second density value by the adding step, a resultant density value of a first subject pixel being equal to or greater than the first density value, the ink droplet having been unejected from one of the plurality of nozzles corresponding to the first subject pixel for a first predetermined period of time, the second correction density value being added to the second density value by the adding step, a resultant density value of a second subject pixel being less than the first density value, the ink droplet having been unejected from one of the plurality of nozzles corresponding to the second subject pixel for a period of time shorter than the first predetermined period of time, wherein the ink droplet is ejected on the first subject pixel whereas the ink droplet is unejected on the second subject pixel.

* * * * *